United States Patent [19]

Gibson

[11] 4,438,820

[45] Mar. 27, 1984

[54] GRADE MONITORING AND STEERING APPARATUS

[76] Inventor: Paul N. Gibson, Rte. 1, Box 153, Saluda, S.C. 29138

[21] Appl. No.: 322,026

[22] Filed: Nov. 16, 1981

[51] Int. Cl.[3] ..... E21B 7/04

[52] U.S. Cl. ..... 175/45; 175/73; 33/377

[58] Field of Search ..... 33/313, 334, 366, 377; 175/45, 61, 73, 76, 325; 299/1; 356/434, 436; 405/184

[56] References Cited

U.S. PATENT DOCUMENTS

| | | | |
|---|---|---|---|
| 2,061,316 | 11/1936 | Brack et al. | 175/76 |
| 2,637,527 | 5/1953 | Andrews, Jr. | 175/45 |
| 2,946,578 | 7/1960 | Smaele | 175/76 |
| 3,324,564 | 6/1967 | Wright et al. . | |
| 3,657,551 | 3/1972 | Lingert et al. | 33/366 |
| 3,851,716 | 12/1974 | Barnes | 175/45 |
| 3,939,926 | 2/1976 | Barnes et al. | 175/24 |
| 4,042,046 | 8/1977 | Capoccia | 175/45 |
| 4,154,000 | 5/1979 | Kramer | 33/366 |

*Primary Examiner*—Ernest R. Purser
*Assistant Examiner*—William P. Neuder
*Attorney, Agent, or Firm*—Dority & Flint

[57] ABSTRACT

Apparatus for monitoring the percent of grade and controlling machinery in response thereto is disclosed. A novel grade sensor A includes a reservoir 14 filled with a translucent fluid medium 30 to a predetermined level L. Grade sensor A is adapted for attachment to associated machinery such as casing head 50 of casing pipe 40 being simultaneously bored and pushed underground. A light emitting diode 18 transmits light through the fluid containing reservoir. Light detector 16 is located opposite the diode for detecting light intensity and has an output representing the intensity. Light intensity changes due to changes in the orientation of the sensor and inclination of the surface level of the fluid medium is used to indicate changes in percent of grade. Electrical means F converts output of detector 16 into a visual display of percent of grade change. Steering apparatus is provided in the form of elongated steering skis B carried exteriously of casing head 50 having a free end 54 for providing reactionary steering force. Inflatable air bag 56 is in operational engagement with free end 54. Supply means D selectively inflate the air bags in response to visual display 84.

19 Claims, 7 Drawing Figures

GRADE MONITORING AND STEERING APPARATUS

BACKGROUND OF THE INVENTION

In the laying of pipe underground such as in the laying of sewer lines, it is necessary to bore and lay the pipe casing underground at a desired percent of grade. It thus becomes necessary to monitor and control the grade of the casing as the bore is cut and the casing is simultaneously pushed through the underground bore to maintain the desired percent of grade. However, the bore and casing cannot be seen as it is formed through extended links underground and the problem of monitoring and maintaining the desired percent of grade is a problem to which considerable attention must be given in order to avoid re-boring.

Heretofore, remote hydraulic grade indicators have been utilized, such as shown in U.S. Pat. No. 3,851,716, which include a sight tube on an indicator board at a boring station connected to a water line which is affixed to the top of the casing being bored and pushed through the ground. Any deviation in the leading edge of the casing from the desired grade either up or down provides a corresponding response to the water level in the sight tube located in the boring pit. Based on the reading of the sight tube, the operator in the boring pit may pivot the head of the casing which carries a cutting head by means of a mechanical linkage. However, the problem arises that the water line connected to the sight tube must be vented on both ends and if the apparatus is utilized below the water table, water can enter the tube and interfere with the reading at the sight tube. The apparatus also has inherent vibration problems which necessitate that the apparatus be shut down to take a reading of the sight tube. The sight tube cannot be monitored simultaneously with the boring operation. With the vibrations, air locks are often created which interfere with the accuracy of the reading in the sight tube. The above inaccuracies can result in the final line being off grade often requiring re-boring. The range of this apparatus is also limited since it reaches its practical limits owing to the mechanical nature of the system. Due to the pivotable connection of the casing head utilized to steer the casing up and down, there is an open space between the casing head and the casing pipe being laid. This space creates a problem if the apparatus is utilized in soft or sandy soil whereby the soil feeds in through the space resulting in cave-in.

An attempt to improve the steering of the above type casing head is disclosed in U.S. Pat. No. 3,939,926 wherein hydraulic actuated wedge mechanisms carried in side openings are utilized to bear against the surrounding earth and provide a steering force. However, this requires considerable complication in the casing head structure and controls therefor. The mechanisms are carried interiorally of the casing head which obstructs flow of the drillings rearwardly from the cutting head.

It has been known to provide a leveling device which utilizes light transmitted through a gravity indicating bubble in a liquid to photoresponsive elements which monitors level conditions such as the spirit level vial shown in U.S. Pat. No. 3,324,564. However, the purposes and problems to which this type of device is directed are not analogous to those herein and such a device would not accurately monitor off-level conditions. The device is also intended for operation in stable environments and would not be suited for use under the dynamic forces of mechanical vibrations owing to the need of maintaining the location of the gravity indicating bubble accurately.

Accordingly, an important object of the present invention is to provide a grade monitor for accurately monitoring the grade of pipe casing being bored and pushed underground.

Still another important object of the present invention is to provide a grade monitor for monitoring the grade of associated mechanical equipment and machinery which is highly accurate and not susceptible to vibrations.

Still another important object of the present invention is to provide grade monitoring and steering apparatus which accurately senses deviations in the percent of grade of casing being bored and laid and changes the direction of the cutting head accordingly in a highly responsive manner.

Yet another important object of the present invention is to provide a slope sensor whose output varies linearly with deviations in percent of grade whereby horizontal bores and lines may be formed true to grade within tolerances of plus or minus one-eighth (⅛") of an inch.

Yet another important object of the present invention is to provide a non-mechanical, solid-state grade monitoring device which can be utilized to monitor and control percent of grade on trenching machinery, motor graders, construction lasers, and other like machinery to obtain a desired percent of grade.

SUMMARY OF THE IVNENTION

The above objectives are accomplished according to the present invention by the use of a novel grade sensor carried on a specially designed casing head. The sensor includes a light-emitting diode and a linear light sensor photo potentiometer arranged in a reservoir filled to a predetermined level with oil. Any change in the grade of the casing head creates a change in the inclination of the oil level in the reservoir through which light is transmitted and a corresponding change in the intensity of light received by the photopotentiometer. The resulting voltage signal is converted to a digital or decimal readout of grade deviation which is used to steer the casing head and sensor back to the desired percent of grade.

The casing head includes a unique steering apparatus which steers the casing back to true grade wherein skis and minature air bags are utilized for steering the leading edge of the casing head which carries the cutting and boring tool. This results in a highly accurate and sensitive monitoring and control system which can maintain the grade plus or minus one-eighth (⅛") of an inch over any length of bore and casing line.

BRIEF DESCRIPTION OF THE DRAWINGS

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein.

DESCRIPTION OF A PREFERRED EMBODIMENT

Figure 1:
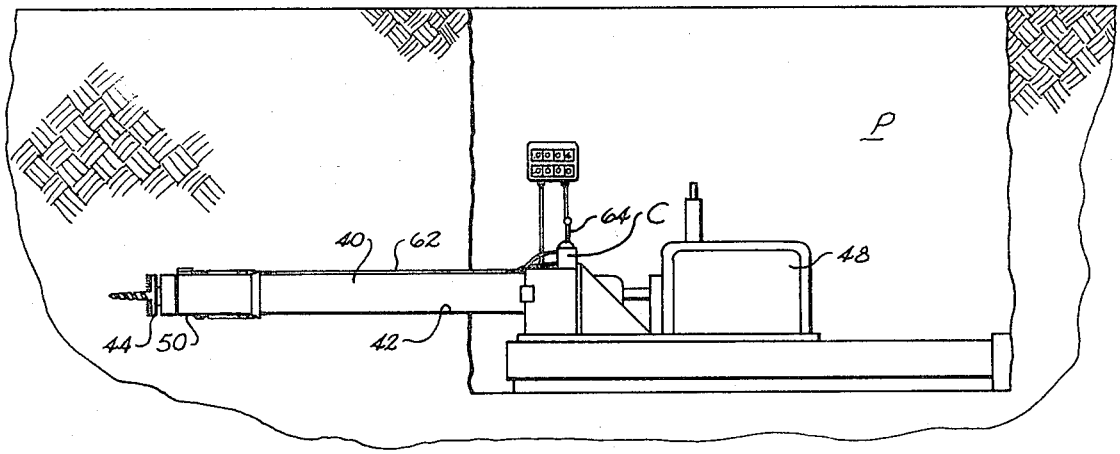
FIG. 1 is an elevation view illustrating boring apparatus incorporating grade monitoring and steering apparatus according to the present invention.
Figure 2A:
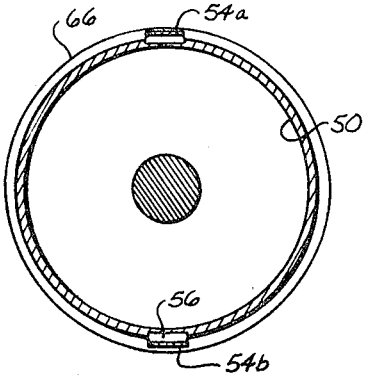
FIG. 2*a* is a sectional view taken along line 2*a*—2*a* of FIG. 2.
Figure 2:
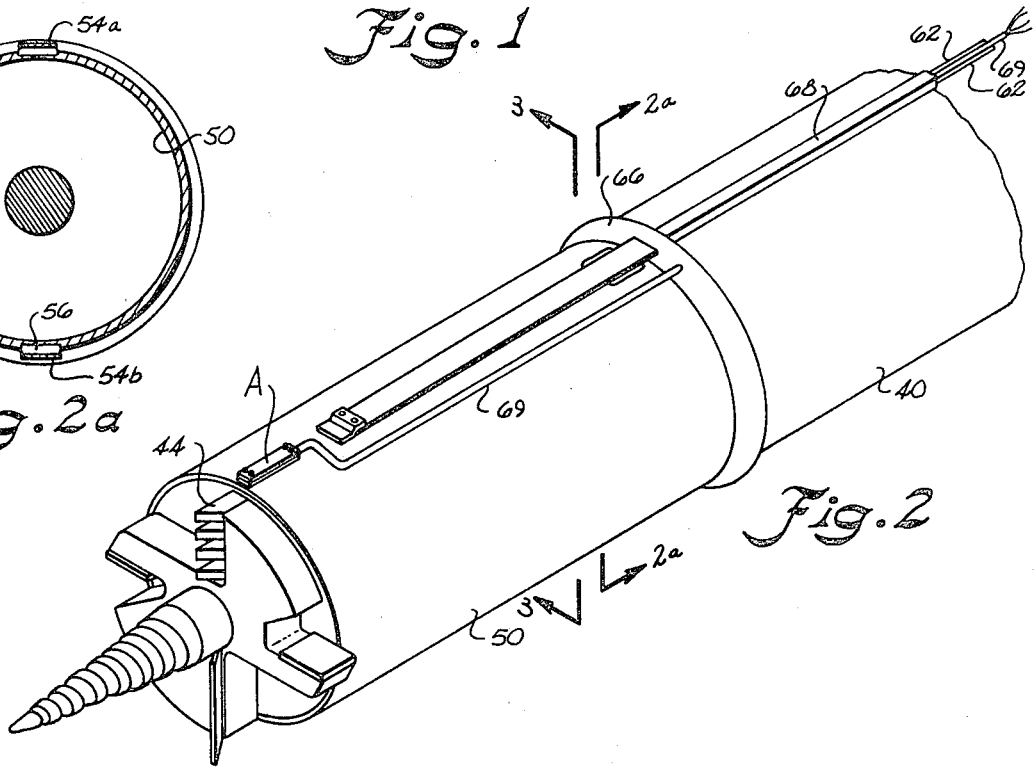
FIG. 2 is a perspective view illustrating a grade monitor constructed according to the present invention as applied to a horizontal boring machine and apparatus for steering the casing according to the invention.
Figure 3:
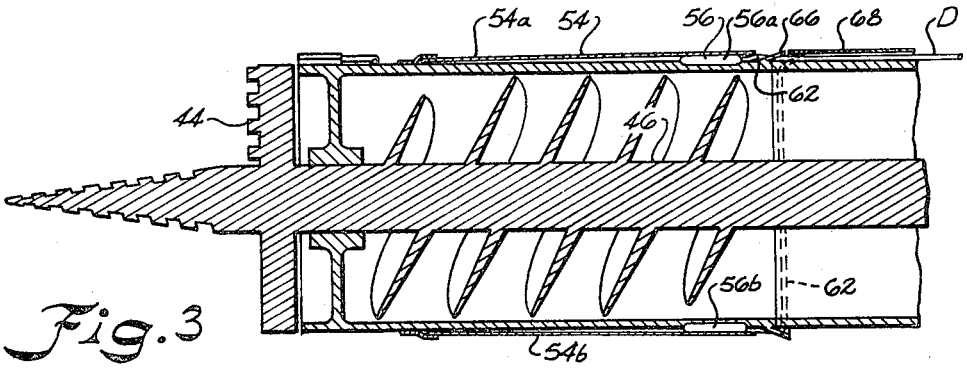
FIG. 3 is a sectional view taken along line 3—3 of FIG. 2.

The invention relates to an apparatus for monitoring and controlling the percent of grade of associated earth working machinery and particularly to earth boring apparatus for boring and laying pipe casing underground. Such a boring operation normally commences from a boring pit station P and is of the type which includes means for forming a bore and pushing the pipe casing through the bore as it is formed. For purposes of this application, the terms slope and grade are used interchangeably.

The boring apparatus includes a casing head carried adjacent the front of the pipe casing. Sensing means A is carried by the casing head sensing the grade of the casing head being pushed through the bore. Elongated steering means B is carried by the casing head having a free end movable away from the casing head producing a reactionary steering force. Actuating means C is in the form of an inflatable actuating air bag carried in operational engagement with the free end of the elongated steering means moving the steering means away from the casing head. Supply means D supplies air to the actuating air bags. Control means E is connected to the supply means for selectively inflating and actuating air bags in response to the sensing means.

Referring now in more detail to the drawings, sensing means A is illustrated according to the invention as including a novel slope sensor having a lower housing 10 and an upper housing 12. The lower housing and upper housing fit together as one piece to define a fluid reservoir 14. In practice, half of the fluid reservoir is formed as a cut-out 14*a* in the lower half 10 and as an identically sized cut-out 14*b* in the top half of the housing 12. In the bottom of cut-out 14*a* is arranged a linear light sensor photopotentiometer (LLS) 16 which may be any suitable light sensor such as that manufactured by Silicone Sensors, Inc. of Dodgeville, Wisc., Model No. SS-1610. Included in the top of the upper reservoir half 14*b* is a light emitting diode (LED) 18 which may be any suitable LED such as a red freznell lens having a wave length of approximately 700 nanometers available from the Hewitt-Packard Corporation. A pair of wires 20, 21 are connected to the sensor or detector 16 and a pair of wires 22, 23 are similarly connected to the LED. For this purpose, any suitable encapsulation and termination of the wires within the light sensor may be made as necessary to make the connections waterproof. The control wires 20–23 are connected back at the boring pit P as input to a computer which takes these signals and converts them to a decimal readout of deviation from the desired percent of grade.

The lower half 10 of the sensor housing includes a groove 26 in which a suitable sealing ring such as 0-ring 28 is placed for sealing the fluid reservoir when the two halves are fitted together. The housing may be made of any suitable material and aluminum is preferred since it dissipates heat fast and causes the sensor to reach the ground temperature as soon as possible reducing the time required for adjustment of the sensor to the ground temperature.

It is important to the linearity of the sensor A that the LED be located exactly midway laterally and longitudinally of the photopotentiometer detecting window. It is also necessary that the fluid medium in the reservoir fill the reservoir to one-half of its depth, d, and that the light source and photopontentiometer be off the longitudinal center as illustrated. This results in the sensor having a linear range in both the up and down directions. The fluid medium is a partially transparent medium and a preferred fluid medium 30 is a 30 weight 2-cycle motor oil manufactured by the Quaker State Corporation which is translucent and has been found to have light transmission properties which, together with the arrangement of diode 16 and detector 18, provides linearity in the operation of the sensor device A in both the up and down directions.

By way of example, grade sensor A will now be described in application to the horizontal boring and laying of pipe casing such as in laying sewer line. Typical horizontal boring apparatus is disclosed in U.S. Pat. No. 3,939,926, which may be referred to for more detail and is hereby incorporated by reference. Since such equipment is well known in the art, only those portions as is necessary to an understanding of the invention will be disclosed herein. Referring in more detail to the drawing, a pipe casing 40 is illustrated being pushed through a bore 42 simultaneous with the bore being formed with a conventional cutting head 44 and auger shown schematically at 46 which conveys the drillings rearwardly through the pipe casing to the boring pit P in a conventional manner. An engine 48 is utilized to drive the auger. The cutting head 44 is journaled in a casing head 50. Casing head 50 is affixed to the front section of casing 40 in any suitable manner such as welding. Slope sensor A is adapted for attachment adjacent to the leading edge of casing head 50 to detect deviations in the grade of the casing head and, hence, the bore cut and casing being laid. Sensor A may be attached by bolts or any other suitable means. Utilization of the sensing signal of sensor A will be described more fully hereinafter.

Steering apparatus for the casing head 50 is provided in the form of elongated steering means B which includes steering skis 54 having a free end 56 movable away from the casing head exterior surface producing a reactionary steering force in an opposite direction. A ski 54*a* is carried on the top of casing head 50 and ski 54*b* directly below and opposed. The other end of ski 54 is pivotably affixed to the casing head exterior by any suitable means such as bracket 58 or welding such as to create a spring effect whereby skis 54 are self-returning. Actuating means C for moving the free end away includes an actuating air bag 60 carried operationally beneath the free, movable end of each steering ski. Means D for supplying air to the air bag includes air lines 62 connected to a source of compressed air (not shown) located at the boring pit. Control means E in the form of a conventional two-way valve 64 is connected in each air line to control the admission and venting of compressed air in a respective air bag. For example, an 18 inch inside diameter casing pipe, skis of 3/16×4×24 inches may be utilized with air bags ½×4×8, ¼ inch air lines, and 60–100 p.s.i. of operating air pressure.

A shroud ring 66 encircles the casing and provides a cover for the junction and routing of air lines 62 and signal lines 20–23 to the boring pit from their respective connecting points. Channel 68 (2×½ inches) may be utilized to enclose and route the lines from the shroud to the pit. A sheath 69 may be utilized to enclose the signal lines.

Figure 6:
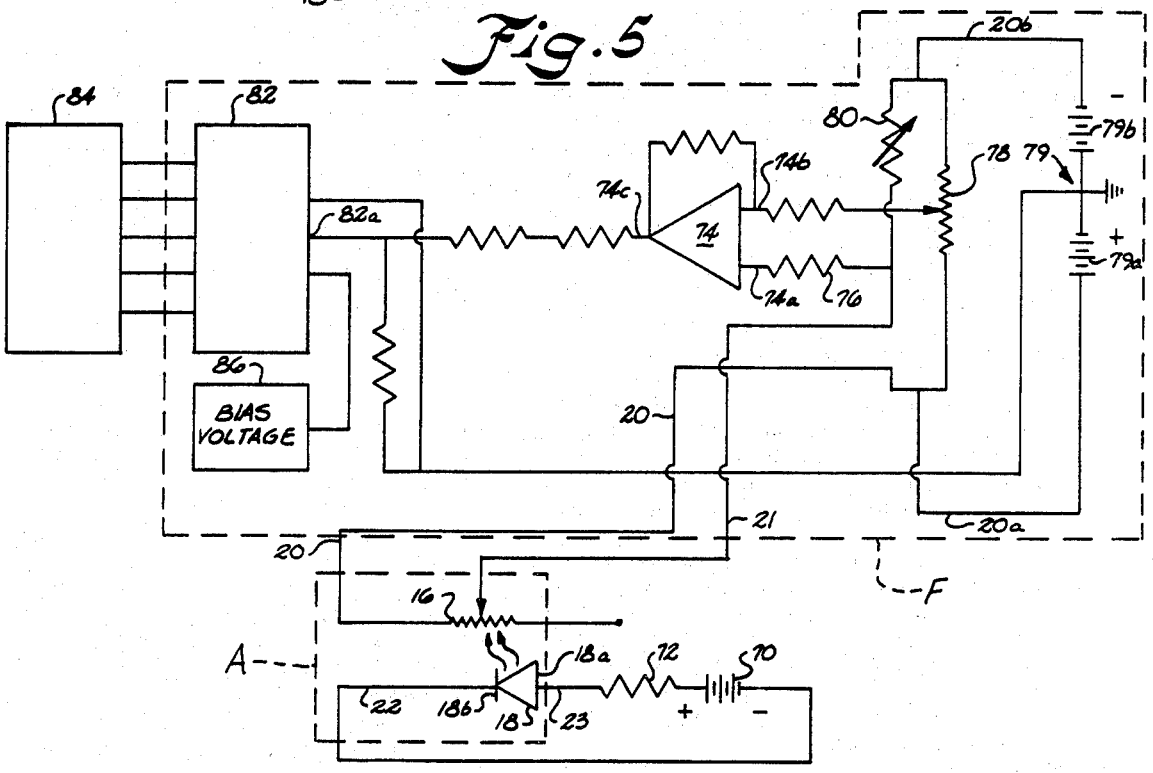
FIG. 6 is a schematic circuit diagram illustrating an electrical circuit for converting analog signals from the grade sensing device of FIG. 5 into a decimal readout signal indicating changes in percent of grade.

Referring now to FIG. 6, a schematic circuit diagram illustrates electrical circuit means F for converting the analog voltage coming from the grade sensor A into a readout on a liquid crystal display unit in the form of plus or minus 100ths of one foot increments in grade deviation. Thus, a decimal signal is generated visually displaying the degree of deviation of sensor A from the true desired percent of grade as a decimal readout.

Figure 4:
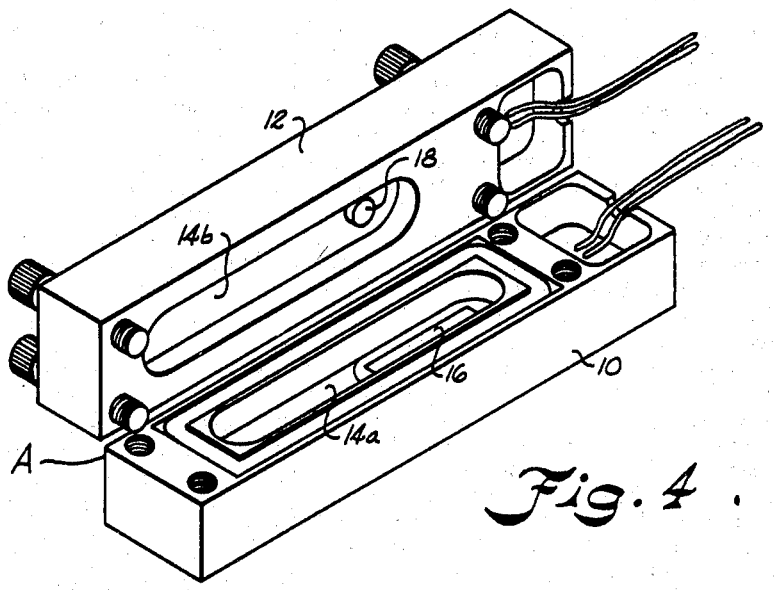
FIG. 4 is a perspective view illustrating a grade sensing device constructed according to the present invention.
Figure 5:
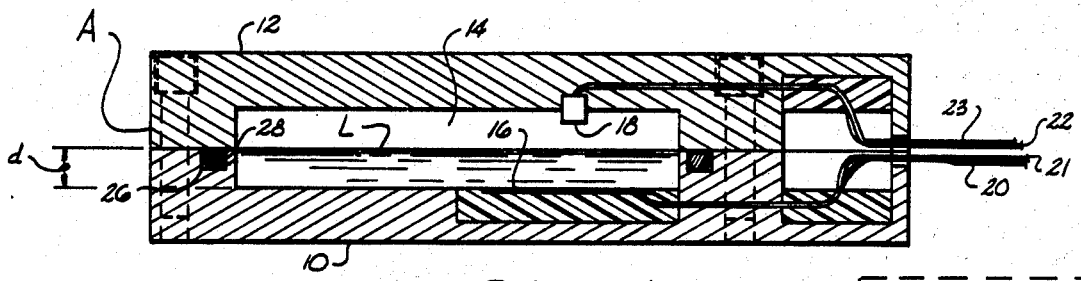
FIG. 5 is a sectional view of a grade sensing device constructed according to the present invention.

As illustrated, leads 23 and 22 from LED 18 are connected to a 9-volt battery source 70. Lead 23 is connected to anode 18*a* and lead 22 to cathode 18*b*. Connected to lead 23 is a resistor 72 to control the intensity of the light from the source to about 4700 ohms. The voltage picked off of the photopotentiometer 16 representing detected light intensity is input to the terminal of an operational amplifier 74 at input terminal 74*a* through a 1 megaohm resistor 76 via lead 21. Amplifier 74 may be a conventional integrated circuit such as circuit no. 7106 available from Intersell, Inc. of California. The remaining lead 20 of LLS device 16 is connected to a second terminal 74*b* of operational amplifier 74 through a potentiometer 78 which is used for setting the gain of operational amplifier 74. The circuit to the LLS device is completed through a balancing resistor 80 by which the reference voltage impressed on the LLS device 16 may be adjusted. The LED 18 is positioned within the housing on an opposed wall from photopotentiometer 16, such as shown in FIGS. 4 and 5. As the inclination of the surface level, L, of the oil varies as a result of the sensor tilting, the voltage produced by photopotentiometer 16 varies linearly with the intensity of the light received thereby.

A DC power supply, shown generally at 79, is provided to power the circuit. The positive side 79*a* of the DC power supply is connected to the lead 20*a* for providing a positive voltage to lead 20. A negative voltage is provided by the DC power supply 79*b* and is supplied to lead 20*b* which has interposed therein adjustable resistor 80 that is, in turn, connected to the input lead 74*a* of the operational amplifier 74.

The aforementioned adjustable resistor 80 enables zeroing of the sensor device A to a reference before initiating the entire circuit. The sensor A is zeroed in at the particular percent of grade that it is oriented at as arranged on casing head 50 which is the desired percent of grade for the casings being laid, and any deviation from that point will cause a plus or minus reading on the decimal readout of change in percent of grade.

The output 74*c* of the operation amplifier 74 is connected to an input terminal 82*a* of integrated circuit 82 which is an analog-to-digital-to-decimal converter and converts the analog signal from the operational amplifier 74 to a digital signal which is displayed as a visual decimal readout on a liquid crystal display 84. Circuit 82 may be any suitable integrated circuit such as circuit no. LF-155 available from the National Semiconductor Corp.

A biasing voltage is supplied to the chip 82 by means of a biasing voltage supply 86. The purpose of the biasing voltage is to provide a reference signal so that when there is a swing above or below this biasing voltage by the analog signal coming out of the operational amplifier, it will cause the signal to be produced in the display 84 to either go positive or negative.

In operation, the operator of the boring equipment will be observing the display 84 of the grade monitor and operating the manual control valve C accordingly. Should a negative decimal increment appear on the display 84 showing that the leading edge of the casing has dipped below the desired percent of grade, the operator actuates the ski 54*b* by admitting air to the actuating air bag 56*b* thus lifting up the leading edge of the casing. Should the display indicate a positive decimal reading indicating that the leading edge has started to travel upwards from the desired percent of grade, the operator may admit air to the air bag controlling ski 54*a* causing the leading edge to tilt downwardly to assume the true percent of grade.

While the grading monitor unit A has been illustrated in an application to the boring and routing of casing in a horizontal bore, it is to be understood that the grading monitor, including sensor A, circuit means F, and visual display 84 also may have application in monitoring the grade of other associated machinery and equipment such as a motor grader. In this application, the sensing unit A may be placed on the draw bar which carries the scrap blade at a desired angle to yield the desired grade of the surface being graded. Any variation in the grade or slope from the desired grade will be detected and displayed at 84 and the slope of the blade adjusted accordingly by the operation of the grader.

The sensing device A may be designed to operate over any desired range of percent of grade. For example, in one embodiment, a sensing device having a linear output was designed to operate over a range of ± ten percent of grade and included a reservoir ⅜×2 inches with a depth or height of ½ of an inch. The oil level was ¼ of an inch (d=¼). The light source 18 was located ½ inch off center. It is to be understood, of course, that other sensing units may be designed to cover wider ranges of percent of grade as required by the application being made utilizing the same ratios and proportions. The above described device has been found to product highly exact linear signals which are accurate within 0.001 of an inch in deviation.

While a preferred embodiment of the invention has been described using specific terms, such description is for illustrative purposes only, and it is to be understood from the spirit or scope of the following claims.

What is claimed is:

1. Apparatus for monitoring the grade of pipe casing being laid in a bore underground simultaneous with said bore being cut of the type which includes a cutting head carried by a casing head attached to the front of said casing, means for steering said casing head up or down to correct the grade of the bore, and means for pushing said casing through said bore as it is formed, said apparatus comprising:

a grade sensor including a reservoir for containing a fluid medium at a predetermined level and adapted for being carried by said casing head;

a light source carried in said reservoir arranged to transmit light through said medium;

a light detector carried in said reservoir opposite said light source for detecting the intensity of said light received through said medium having an output representing said light intensity;

whereby changes in the intensity of light detected due to changes in the inclination of-said sensor and of said level of medium may be utilized to produce indications of deviations in grade of said casing head and said steering means may be adjusted to return said casing head to grade.

2. The apparatus of claim 1 including electrical means converting said output of said detector into a visual display of change in precent of grade of said casing head and sensor carried thereon.

3. Earth boring apparatus for boring and laying pipe casing underground of the type which includes means for boring and pushing the casing through the bore as the bore is made, said apparatus comprising:

a casing head carried by the front of said pipe casing;

elongated steering means carried by said casing head having at least one end movable away from said casing head against the surrounding earth producing a steering reactionary force for actively steering said casing head while it is moving;

said steering means moving toward and away from said casing head without penetration into the interior thereof while the casing head is moving for facilitating steering;

fluid actuating means moving said steering means away from said casing head;

sensing means carried by said casing head sensing the grade of said casing head being pushed through said bore; and control means controlling said actuating means in response to said sensing means.

4. The apparatus of claim 3 wherein said control means is manually operated in response to said sensing means.

5. The apparatus of claim 3 wherein said steering means includes at least one elongated ski element carried exteriorally of said head having one end pivotably affixed to said casing head.

6. The apparatus of claims 3 or 5 wherein said actuator means includes an inflatable air bag carried by said casing head in operational engagement with said movable end of said steering means, air supply means connected to said air bag, said control means connected to said air supply means selectively supplying air for inflating said air bag thereby moving said steering means.

7. Earth boring apparatus for boring and laying pipe casing underground commencing from a boring pit station of the type which includes means for forming a bore and pushing the pipe casing through the bore as it is formed, said apparatus comprising:

a casing head carried adjacent the front of said pipe casing;

elongated steering means carried by said casing head having a free end movable away from said casing head at an inclination to said casing head for producing a reactionary steering force for actively steering of said casing head moving through said bore during boring;

an inflatable actuating air bag carried in operational engagement with said free end of said elongated steering means for moving said steering means away from said casing head while the casing head is moving;

supply means supplying air to said actuating air bags;

sensing means carried by said casing head sensing the grade of said casing head being pushed through said bore; and control means connected to said supply means for selectively inflating and actuating said air bags in response to said sensing means.

8. The apparatus of claim 7 including circuit means having display means for displaying signals from said sensor means indicating changes in percent of grade of said casing head, signal lines connecting said sensing means and circuit means.

9. The apparatus of claim 8 including elongated channel means routing and enclosing said signal lines.

10. The apparatus of claim 7 including shroud means encircling said casing covering said air supply means.

11. A grade monitoring device for monitoring the grade of associated grading machinery comprising:

a housing adapted for attachment to said machinery;

a reservoir in said housing adapted for containing a fluid medium at a predetermined surface level;

a light source disposed to transmit light through said medium;

means for detecting the intensity of light transmitted through said medium and producing an output signal responsive to said light intensity; and said surface level of said fluid medium in said reservoir changing in inclination in response to changes in the orientation of said device whereby the intensity of light varies to produce a signal by said detector means representing changes in percent of grade of said associated machinery;

whereby the grade of said machinery may be adjusted.

12. A grade sensor device comprising:

a housing having a reservoir;

a partially transparent fluid medium contained within said reservoir;

a light source arranged to transmit light through said medium;

detector means receiving light transmitted through said medium and producing an output signal representative of the intensity of said light received thereby;

said fluid medium partially filling said reservoir to a predetermined level whereby the output signal of said detector means varies linearly with changes in the inclination of the surface level of said fluid medium;

said surface level of said fluid medium through which said light is transmitted changing its inclination in response to changes in orientation of said sensor device;

whereby the intensity of light detected changes resulting in an output signal being produced by said detector means indicative of said change in grade of said device.

13. The device of claim 12 wherein said fluid medium fills approximately one-half the depth of said reservoir.

14. The device of claim 13 wherein said light source is arranged approximately midway laterally and longitudinally of said detector means.

15. The device of claim 12 wherein said fluid medium includes a colored oil lubricant.

16. Apparatus for use in boring and laying pipe casing underground of the type which includes means for boring and pushing the casing through the bore as the bore is made and means for sensing the percent of grade of said casing, said apparatus comprising:

a casing head for attachment adjacent the front of said pipe casing;

elongated steering means carried by said casing head having at least one end movable away from said casing head against the surrounding earth producing a steering reactionary force for actively steering said casing head while it is moving;

said steering means moving toward and away from said casing head without penetration into the interior thereof while the casing head is moving for facilitating steering;

fluid actuating means moving said steering means away from said casing head; and control means controlling said actuating means in response to said sensing means.

17. The apparatus of claim 16 wherein said control means is manually operated in response to said sensing means.

18. The apparatus of claim 16 wherein said steering means includes at least one elongated ski element carried exteriorally of said head having one end pivotably affixed to said casing head.

19. The apparatus of claim 16 wherein said actuating means includes an inflatable actuating air bag carried in operational engagement with said free end of said elongated steering means moving said steering means away from said casing head.

* * * * *